US009849485B2

(12) United States Patent
McLean

(10) Patent No.: US 9,849,485 B2
(45) Date of Patent: Dec. 26, 2017

(54) SYSTEM, APPARATUS AND/OR METHOD FOR REPAIRING SIFTING AND/OR FILTERING SCREENS USING PLUGS WITH A MESH LAYER

(71) Applicant: M-I DRILLING FLUIDS UK LTD., Westhill, Aberdeen (GB)

(72) Inventor: Claire Rosaleen Galloway McLean, Westhill (GB)

(73) Assignee: M-I DRILLING FLUIDS UK LTD, Westhill, Aberdeen, Scotland (GB)

( * ) Notice: Subject to any disclaimer, the term of this patent is extended or adjusted under 35 U.S.C. 154(b) by 1 day.

(21) Appl. No.: 14/892,918

(22) PCT Filed: Oct. 22, 2014

(86) PCT No.: PCT/US2014/061738
§ 371 (c)(1),
(2) Date: Nov. 20, 2015

(87) PCT Pub. No.: WO2015/142386
PCT Pub. Date: Sep. 24, 2015

(65) Prior Publication Data

US 2016/0101439 A1 Apr. 14, 2016

Related U.S. Application Data

(60) Provisional application No. 61/894,206, filed on Oct. 22, 2013.

(51) Int. Cl.
*B07B 1/28* (2006.01)
*B07B 1/46* (2006.01)

(52) U.S. Cl.
CPC ..... *B07B 1/28* (2013.01); *B07B 1/4627* (2013.01); *B07B 1/4645* (2013.01); *B07B 1/46* (2013.01)

(58) Field of Classification Search
CPC ..... B07B 1/46; B07B 1/4627; B07B 1/4645; B07B 1/4609; B07B 1/4681
USPC ..... 209/399, 401, 403, 405
See application file for complete search history.

(56) References Cited

U.S. PATENT DOCUMENTS

2002/0000399 A1* 1/2002 Winkler ..... B01D 29/012 209/399
2003/0042190 A1* 3/2003 Robertson ..... B07B 1/4627 210/232
2010/0201081 A1* 8/2010 Ralph ..... B07B 1/4627 277/650

* cited by examiner

*Primary Examiner* — Joseph C Rodriguez
*Assistant Examiner* — Kalyanavenkateshware Kumar
(74) *Attorney, Agent, or Firm* — M-I L.L.C.

(57) ABSTRACT

System, method and/or apparatus repairs an area of damaged mesh in a sifter screen (80). Such sifter screens (80) have woven wire mesh (81) stretched, tensioned and/or secured over a supporting frame (85) having cells (82). Damage occurs to the mesh (81) over certain cells (82). A plug (10) having a mesh layer (14) inserts and/or locks into place in the damaged cell (89). The mesh layer (14) of the plug (10) is flush with the mesh (81) on the sifting screen (80). Ridges (62) and/or ledges (66) secure the plug (10) in place by engaging a lip (96) in the damaged cell (89) to snap-fit the plug (10) in place.

19 Claims, 6 Drawing Sheets

SYSTEM, APPARATUS AND/OR METHOD FOR REPAIRING SIFTING AND/OR FILTERING SCREENS USING PLUGS WITH A MESH LAYER

BACKGROUND

The embodiments disclosed herein relate generally to a system, an apparatus, and/or a method for filtering and/or separating particles. More specifically, embodiments disclosed herein relate to a system, an apparatus, and/or a method for repairing damaged sifter screens using plugs with a mesh layer.

Sifter screens are used to filter particles in industrial filtration systems. Different sizes and/or types of particles may be separated using filter screens in a vibratory separator. In the oil and gas industry, for example, shale shakers use filter screens to separate drill cuttings from drilling fluid in on-shore and/or off-shore oilfield drilling. The sifter screens have a wire mesh fixed across a frame. The frame has a rectangular grid of support ribs that divide the frame into an orthogonal array of cells. The mesh is secured to the ribs as well as to the surrounding frame. To promote separation, vibrational and/or circular motion is applied to the sifter screen.

The wire mesh has different mesh sizes defined by the size of the apertures between the individual wires in the mesh. The size of the apertures of the mesh is selected depending on the size of the particle to be filtered. Particles smaller than the aperture pass through the wire mesh and/or through the cells between the ribs. The remaining particles are discharged at an end of the filter screen. The discharged particles are collected in a bin and/or a pit. The particles and/or fluid that pass through the mesh are collected in a pan and/or a sump below the sifter screen. The particles and/or fluid that pass through the mesh may also pass through a secondary processing system, such as a degasser.

Over the life of the filter screen, the particles cause wear on the wire mesh. Because of the cellular structure, the strain and/or damage experienced by the mesh is isolated over each cell. Damage causes a breach in the mesh in one or more of the small unsupported areas between the cells. As a result, that area of the mesh allows larger particles to pass through than desired. Once the damage occurs, the screen must be replaced or repaired. Certain regions of the mesh are more prone to damage than other regions. For example, the mesh stretched across cells below where the particles are introduced experience greater wear than the mesh stretched across cells towards the exit end of the screen.

To extend the operational life of the screen, the cell with the damaged mesh may be blocked by epoxy or other plastic or resin based material. Alternatively, solid plugs may be installed into the cell to block particles from going through damaged wire mesh. These solid plugs fit into the cells and have a solid surface oriented towards the damaged mesh. The solid plugs fit into the cell from below and are hammered into place. As such, these solutions are designed to block particles from traveling through the damaged screen and/or the cell. Therefore, the cells with the epoxy or solid plugs no longer filter particles.

The solid plugs cannot be reused as they are hammered in place without a way to remove them. As more of the plugs are installed into more of the cells, the filtering ability of the filter screen is reduced. As more solid plugs are installed, the filter screen must eventually be replaced. When the filter screen is discarded, the installed plugs are also discarded.

DETAILED DESCRIPTION

The embodiments disclosed herein relate generally to a system, an apparatus, and/or a method for filtering and/or separating particles. More specifically, embodiments disclosed herein relate to a system, an apparatus, and/or a method for repairing damaged sifter screens using plugs with a mesh layer.

Sifter screens may be used to filter particles in industrial filtration systems. Different sizes and/or types of particles may be separated using filter screens in a vibratory separator. In the oil and gas industry, for example, shale shakers may use filter screens to separate drill cuttings from drilling fluid in on-shore and/or off-shore oilfield drilling. The sifter screens may have a wire mesh fixed across a frame. The wire mesh may be glued and/or embedded into the frame. The frame may have a rectangular grid of support ribs that may divide the frame into an orthogonal array of cells. The mesh may be secured to the ribs as well as to the surrounding frame. To promote separation, vibrational and/or circular motion may be applied to the sifter screen.

Figure 1:
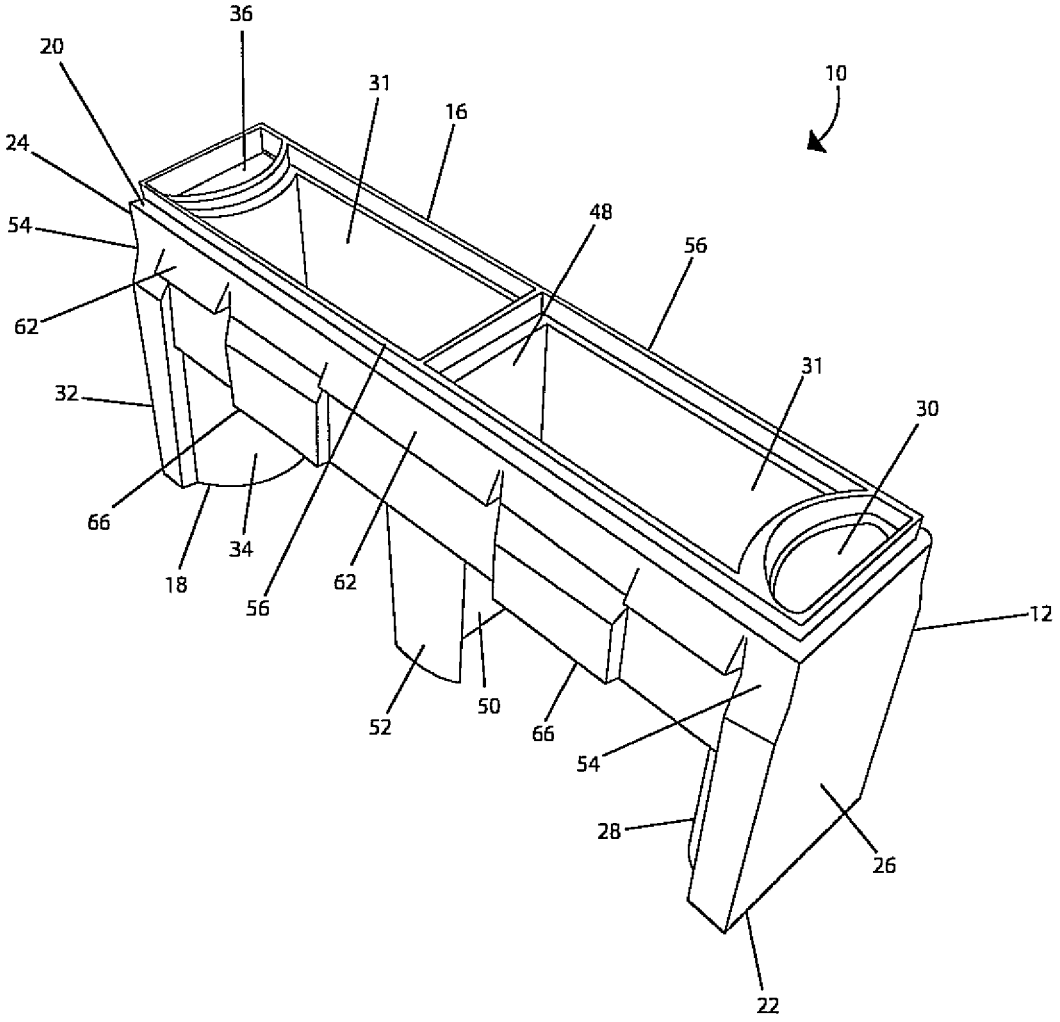
FIG. 1 illustrates an isometric view of an embodiment of a plug.
Figure 2:
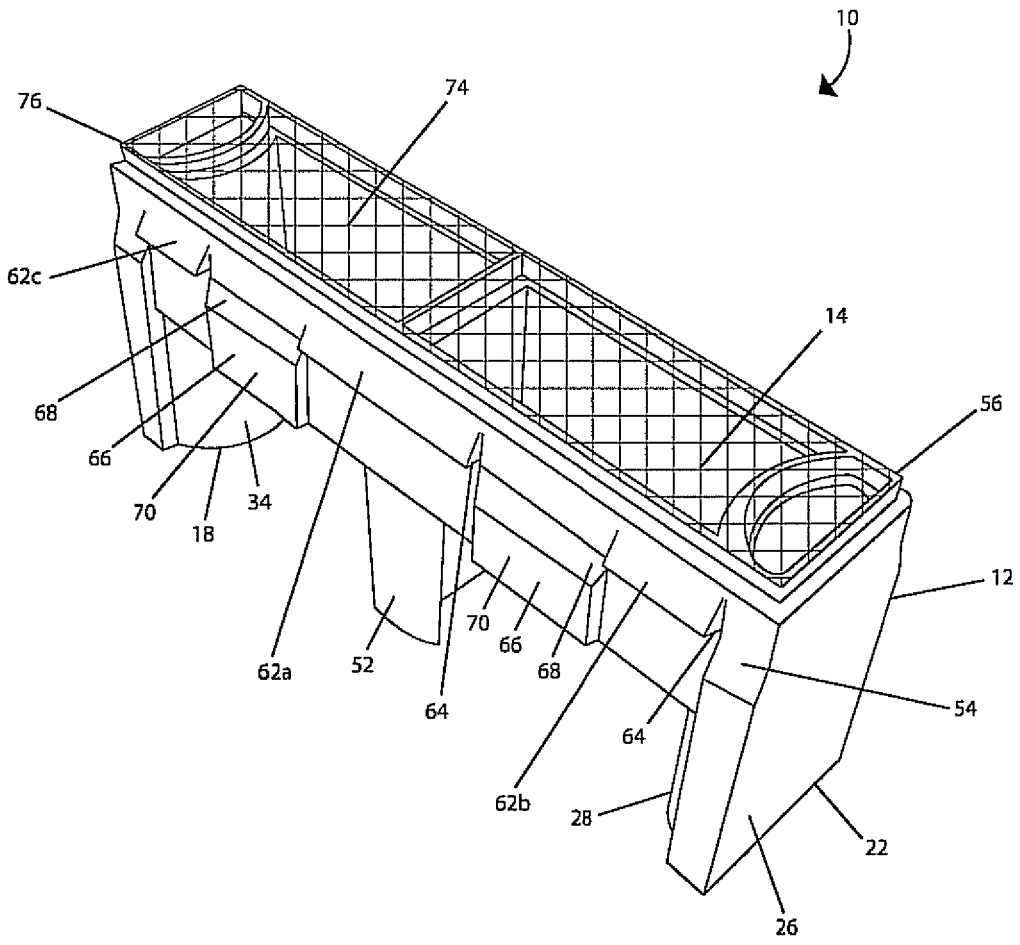
FIG. 2 illustrates an isometric view of an embodiment of the plug with a mesh layer.
Figure 3:
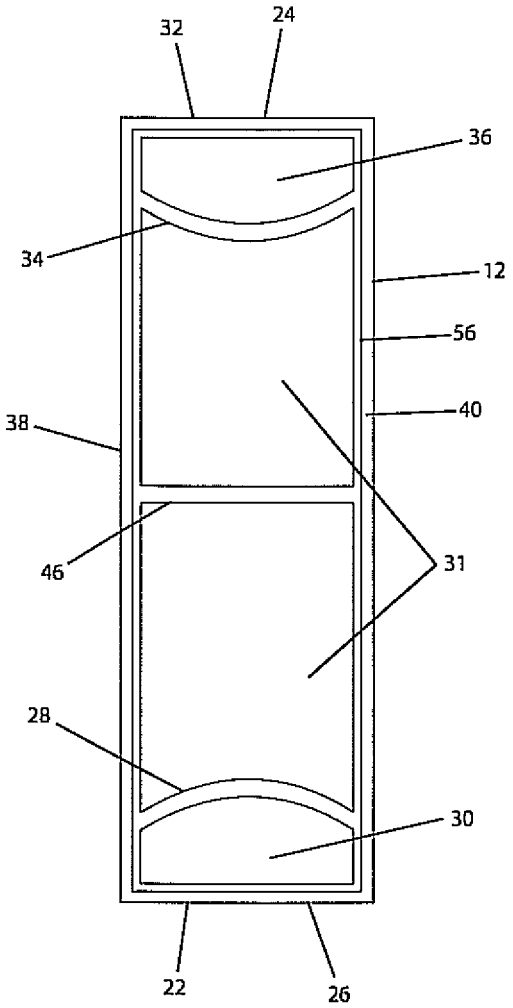
FIG. 3 illustrates a top view of an embodiment of the plug.

Referring to FIGS. 1-3, an embodiment of a plug 10 is shown. FIG. 1 illustrates an embodiment of the plug 10 having a body 12. FIG. 2 illustrates an embodiment of the plug 10 wherein the body 12 of the plug 10 has a mesh layer 14. FIG. 3 illustrates a top plan view of an embodiment of the plug 10.

In an embodiment, the body 12 may have a top 16, a bottom 18 and/or a top surface 20. The body 12 may be manufactured from a resilient plastic material, a thermoplastic material and/or a composite of glass reinforced plastic material. In an embodiment, the body 12 may be molded as one piece.

The body 12 may have a first end 22 and/or a second end 24. The first end 22 may be located in a position opposite to the second end 24. The first 22 end may have a flat wall 26, a convex wall 28 and/or a space 30 defined between the flat wall 26 and the convex wall 28. The convex wall 28 of the first end 22 may extend into an interior portion 31 of the body 12. The second end 24 may have a flat wall 32, a convex wall 34 and/or a space 36 defined between the flat wall 32 and the convex wall 34. The convex wall 34 of the second end 24 may extend into the interior portion 31 of the body 12.

The body 12 may have a first side 38 and/or a second side 40. The second side 40 may be located in a position opposite to the first side 38. The first side 38 may extend a length from the first end 22 to the second end 24. The second side 40 may extend a length from the first end 22 to the second end 24. The interior portion 31 of the body 12 may be defined by the first side 38 and/or the second side 40.

Figure 4:
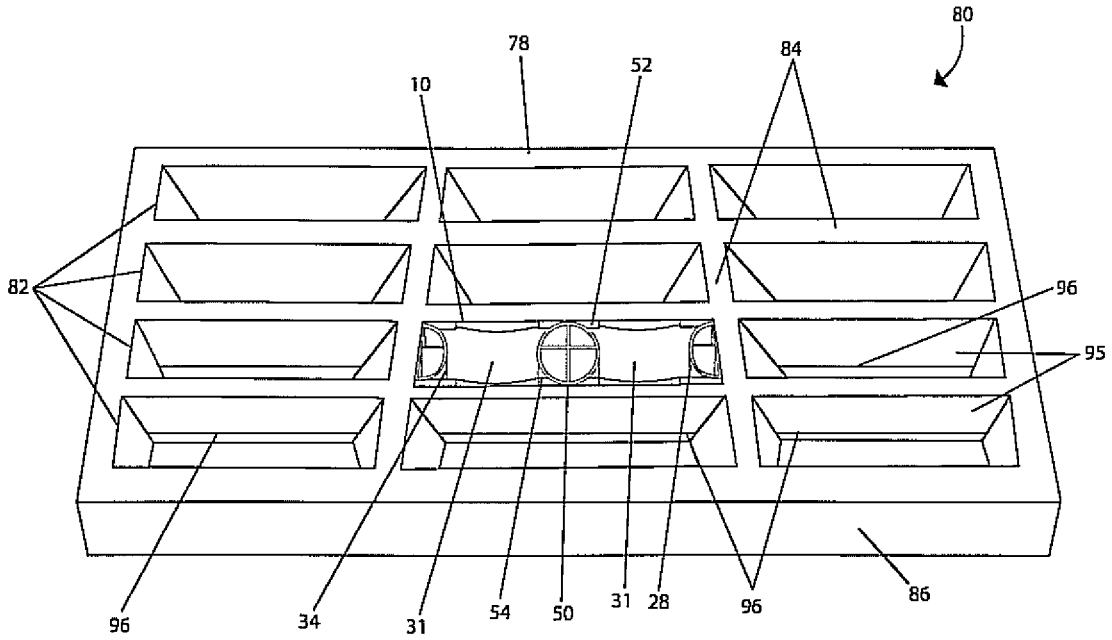
FIG. 4 illustrates an isometric view of the bottom of a sifter screen with an embodiment of the plug inserted into a cell of the sifter screen.

A support member 46 may extend between the first side 38 and/or the second side 40. The support member 46 may be located in a position between the first end 22 and/or the second end 24 of the body 12. In an embodiment, the support member 46 may be equidistant from the first end 22 and the second end 24. The support member 46 may have an upper portion 48 and/or a lower portion 50. The upper portion 48 may have a width defined by the first side 38 and/or the second side 40. The lower portion 50 may be located in a position between the upper portion 48 and the bottom 18 of the body 12. The lower portion 50 of the support member 46 may have a first side support 52 that may be adjacent to the first side 38. The first side support 52 may be parallel to the first side 38 and/or perpendicular to the support member 46. The lower portion 50 of the support member 46 may have a second side support 54 that may be adjacent to the second side 40 as shown in FIG. 4. The second side support 54 may be parallel to the second side 40 and/or may be perpendicular to the support member 46.

At the top 16 of the body 12, the top surface 20 may be formed by the first end 22, the second end 24, the first side 38, the second side 40 and/or the support member 46. The top surface 20 may be generally planar. A rim 56 may extend from the top surface 20 of the body 12. The rim 56 may have a thickness less than the thickness of the top surface 20. The rim 56 may be formed on the top surface 20 on each of the first end 22, the second end 24, the first side 38 and/or the second side 40 of the body 12. Moreover, in an embodiment, the rim 56 may be formed on the top surface 20 on each of the convex wall 28, the convex wall 34 and/or the support member 46.

Referring to FIGS. 1 and 2, the flat wall 26 at the first end 22 of the body 12 and/or the flat wall 32 at the second end 24 of the body 12 may have a reduced width portion 54. Thus, a portion of the flat wall 26 at the first end 22 and/or a portion of the flat wall 32 at the second end 24 may extend beyond the first side 38 of the body 12 and/or the second side 40 of the body 12. The first side 38 of the body 12 and/or the second side 40 of the body 12 may be recessed within the overall width of the flat wall 26 and/or the flat wall 32.

The first side 38 of the body 12 and/or the second side 40 of the body 12 may each have ridges 62 which may protrude outwardly from the body 12. In an embodiment, the first side 38 and/or the second side 40 may each have a central ridge 62*a*, a first end ridge 62*b* and/or a second end ridge 62*c*. The central ridge 62*a* may be longer than the first end ridge 62*b* and/or the second end ridge 62*c*. In an embodiment, the central ridge 62*a* on the first side 38 may be located in a position at which the support member 46 may intersect the first side 38. Additionally, the central ridge 62*a* on the second side 38 may be located in a position at which the support member 46 may intersect the second side 40. The first end ridge 62*b* may be located in a position that may be adjacent to the reduced width portion 54 of the flat wall 26 at the first end 22 of the body 12. The second end ridge 62*c* may be located in a position that may be adjacent to the reduced width portion 54 of the flat wall 32 at the first end 24 of the body 12.

In another embodiment, the central ridge 62*a* on the first side 38 and/or the second side 40 may be equidistant from the first end and the second end 24. The first end ridge 62*b* may abut the first end 22. Additionally, the second end ridge 62*c* may abut the second end 24. The ridges 62 may have a triangular cross-section. The ridges 62 may have a flat side 64 that may extend perpendicular to the first side 38 of the body 12 and/or the second side 40 of the body 12.

The first side 38 and/or the second side 40 may each have ledges 66 that may be located on the body 12. The ledges 66 may be located in positions between the ridges 62. The ledges 66 may have a tapered portion 68 and/or a body portion 70. The body portion 70 may protrude outwardly away from the first side 38 of the body 12 and/or from the second side 40 of the body 12. The body portion 70 of the ledges 66 may extend outwardly a first distance from each of the first side 38 and/or the second side 40 of the body 12. The ridges 62 may extend outwardly a second distance from each of the first side 38 and/or the second side 40 of the body 12. In an embodiment, the first distance and the second distance may be equal.

The tapered portion 68 of each of the ledges 66 may protrude outwardly from each of the first side 38 of the body 12 and/or the second side 40 of the body 12. The tapered portion 68 may be angled downwardly to the body portion 70 of the ledge 66.

As shown in FIG. 2, the mesh layer 14 may be affixed onto the top 16 of the body 12. The mesh layer 14 may have a top side 74 and/or a bottom side 76. The bottom side 76 of the mesh layer 14 may be located in a position opposite to the top side 74 of the mesh layer 14. In an embodiment, the bottom side 76 of the mesh layer 14 may be supported by the rim 56 extending from the top surface 20 of the body 12. The mesh layer 14 may be glued to the rim 56.

In another embodiment, the mesh layer 14 may be embedded into the rim 56. In such an embodiment, the body 12 may be made from a thermoplastic material. The mesh layer 14 may be placed on the rim 56. Heat and/or pressure may be applied to the mesh layer 14 and/or the rim 56. The thermoplastic material of the rim 56 may melt around the mesh layer 14. The rim 56 may subsequently cool, harden and/or encompass the portion of the mesh layer 14 in contact with the rim 56 to hold the mesh layer 14 in place.

The mesh layer 14 may be a single layer of woven mesh wire or may be multiple layers of woven mesh wire. The mesh layer 14 may be a mesh cloth. The mesh layer 14 may have a mesh size to filter particles. For example, the mesh layer 14 may have the mesh size to separate drill cuttings from circulated drill fluid. The mesh size as used herein refers to the size of the apertures in the mesh layer 14.

Figure 5:
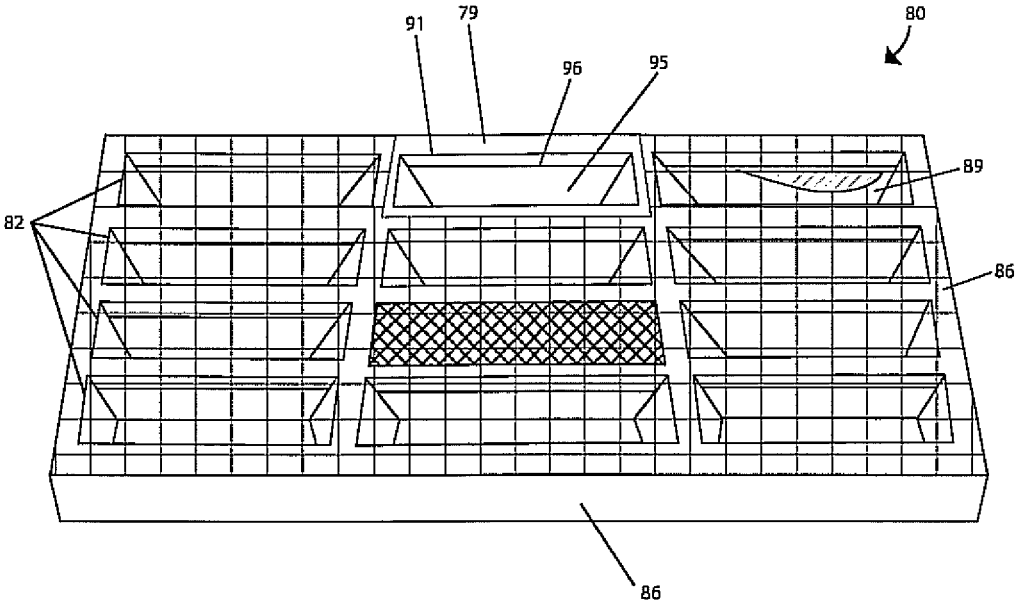
FIG. 5 illustrates an isometric view of the top of the sifter screen with an embodiment of the plug inserted into a cell of the sifter screen.

Referring to FIGS. 4 and 5, a sifter screen 80 which may be used in an industrial filtration system (not shown) is illustrated. The sifter screen 80 may have a bottom 78 and/or a top 79. The top of the sifter screen 80 may have a mesh 81 that may filter liquids and/or particles. As shown in FIGS. 4 and 5, the sifter screen 80 may be divided into rectangular cells 82 by an orthogonal array of ribs 84 and/or a perimeter frame 86. In an embodiment, the sifter screen 80 may have twelve cells 82 as shown. However, in other embodiments, depending upon the size and/or configuration of the sifter screen 80, the number of cells 82 may be more than 100 cells, for example.

In an embodiment of the sifter screen 80, the mesh 81 may be glued to the orthogonal array of ribs 84 and/or the perimeter frame 86. In an embodiment, the mesh 81 may be embedded into the orthogonal array of ribs 84 and/or the perimeter frame 86. In such an embodiment, the sifter screen 80 may be made from a thermoplastic material. The mesh 81 may be placed on the top 79 of the sifter screen 80. Heat and/or pressure may be applied to the mesh 81 and/or to the sifter screen 80. The thermoplastic material of the sifter screen 80 may melt around the mesh 81. The sifter screen 80 may subsequently cool, harden and/or encompass the portion of the mesh 81 in contact with the sifter screen 80 to hold the mesh 81 in place. The mesh 81 may cover the top 79 of the sifter screen 80 and/or may extend over the perimeter frame 86.

In another embodiment, the mesh 81 may be attached to the orthogonal array of ribs 84 and/or the perimeter frame 86. Moreover, the mesh 81 above each of the cells 82 may be isolated from one cell 82 to another adjacent cell 82.

During use, the sifter screen 80 may become damaged. For example, shale shakers that may be used in the oil and gas industry may separate drill cuttings from drilling fluid in on-shore and/or off-shore oilfield drilling. Such a harsh environment may be destructive to the sifter screen 80 over a period of extended use. For example, the mesh 81 above one or more of the cells 82 may become damaged from repeated exposure to the drill cuttings. Periodic inspections of the sifter screen 80 may indicate that damage may have occurred to the mesh 81. For example, FIG. 5 illustrates a damaged cell 89. The mesh 81 may be torn and/or otherwise damaged above the damaged cell 89. The mesh 81 may be removed without removing the non-damaged portion of the mesh 81 over the other cells 82.

To begin a repair of the damaged cell 89, the sifter screen 80 may be removed from the industrial filtration system (not shown). The damaged portion of the mesh 81 of the sifter screen 80 may be identified. In particular, the damaged cell 89 corresponding to the damaged portion of the mesh 81 may be identified. If a large portion of the mesh 81 becomes damaged, more than one cell 82 may be damaged. Thus, more than one cell 82 may be identified and/or repaired. The mesh 81 of the sifter screen 80 above the damaged cell 89 may be removed.

Figure 6:
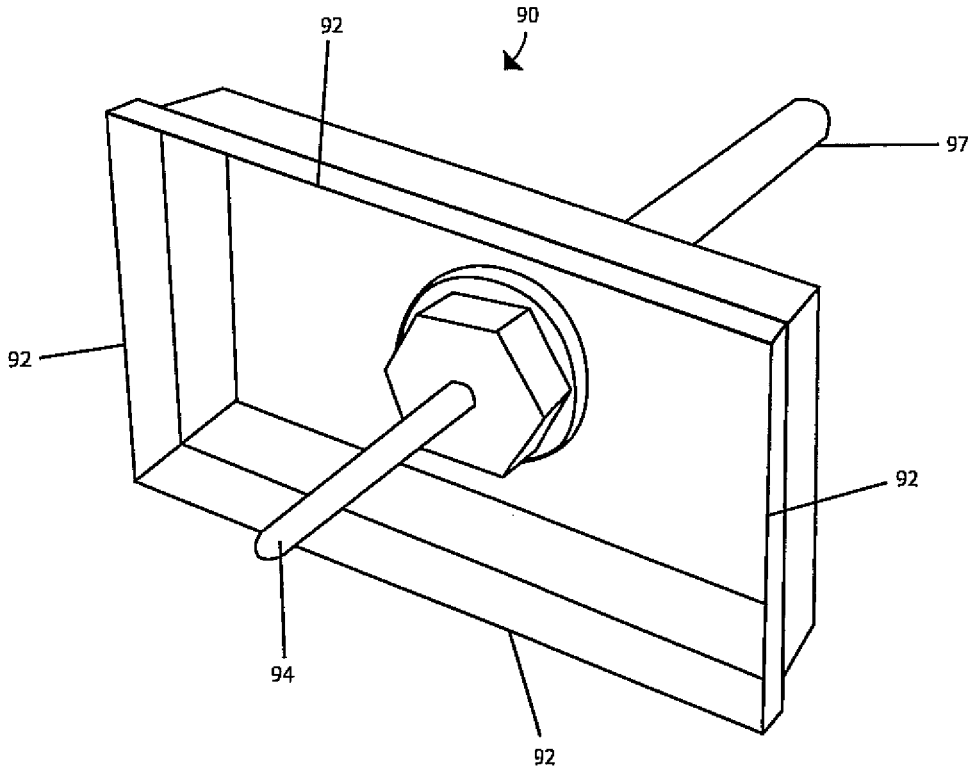
FIG. 6 illustrates a cutting tool useful in embodiments disclosed herein.

FIG. 6 illustrates a cutting tool 90 that may be useful in embodiments of a repair system for the sifter screens 80 as disclosed herein. The cutting tool 90 may be sized and/or configured to fit over the damaged cell 89. The cutting tool 90 may have a rectangular shape to replicate the rectangular shape of the damaged cell 89. The cutting tool 90 may have cutting edges 92 on the rectangular periphery of the cutting tool 90. The cutting tool 90 may be dimensioned to fit on the orthogonal array of ribs 84 over the mesh 81 of the damaged cell 89.

The cutting tool 90 may have an alignment rod 94 to aid in positioning the cutting tool 90 over the damaged cell 89. The alignment rod 94 may be located in the center of the cutting tool 90. The alignment rod 94 may be placed on the center of the damaged cell 89 to position the cutting tool 90 over the damaged cell 89 for removal of the damaged mesh 81. The cutting tool 90 may have a striking rod 97. A hammer and/or a mallet (not shown) may be used to hit the striking rod 97 to impart a force to the cutting edges 92 of the cutting tool 90. The cutting edges 92 may thereby sever the mesh 81 around the periphery of the damaged cell 89. All layers of screen cloth, not just the damaged top layer of the mesh 81, may be cut from the individual damaged cell 89 relative to the other discrete cells 82. The removal of the mesh 81 may be performed prior to repairing the sifter screen 80 with the plug 10 having the mesh layer 14. FIG. 5 illustrates an open cell 91 after removal of the mesh 81. The open cell 91 may receive the plug 10 having the mesh layer 14.

U.S. Pat. No. 6,872,466, assigned to the assignee of the present application and incorporated herein by reference in its entirety, discloses a method and apparatus for repairing screens. A plug may be inserted into a cell to form a locking connection. To this end, side faces of the ribs in each cell may be provided with lips which may be parallel to and spaced from the underside of the mesh. The plug may be adapted to be fitted in place by forcing at least part of the plug beyond the lips so that the plug snaps into place below the damaged mesh. The lips may be formed on the side faces of the two ribs defining the cell. The lips and ridges conveniently may have inclined surfaces to facilitate insertion of the plug into the cell and substantially perpendicular faces which may engage to inhibit movement in the reverse direction, once the plug is snapped into place.

As shown in FIGS. 4 and 5, the plug 10 may be dimensioned to fit within the cell 82. Different sifter screens 80 may have different sizes of the cells 82. Accordingly, the plug 10 may have different sizes. The plug 10 may be dimensioned to fit into the cell 82 so that no liquids or solids may pass between the cell 82 and/or the plug 10. The mesh size of the mesh layer 14 of the plug 10 may be equal to the mesh size of the mesh 81 of the sifter screen 80.

Each of the cells 82 may have interior walls 95 with a lip 96 corresponding to the ridges 62 of the first side 38 of the body 12 of the plug 10 and/or the second side 40 of the body 12 of the plug 10. The lip 96 may interface with the flat side 64 of the ridges 62 to lock the plug 10 into the cell 82. The lip 96 may interface with the tapered portion 68 of each of the ledges 66 to lock the plug 10 into the cell 82.

To insert the plug 10 into the cell 82, the sifter screen 80 may be positioned so that the top 79 of the sifter screen 80 may face down on a flat surface. As shown in FIG. 4, the bottom 78 of the sifter screen 80 may face up. The plug 10 may be positioned in the cell 82 so that the mesh layer 14 of the plug 10 may face into the cell 82.

The plug 10 may be pushed by hand into the cell 82 until the plug 10 may encounter resistance from a tight fit. The fit between the plug 10 and the cell 82 may be an interference fit. A hammer and/or a mallet (not shown) may be used to hit the bottom 18 of the plug 10. The hammer and/or the mallet may be used to hit the lower portion 50 of the support member 46 in the center of the plug 10. The bottom 18 of the plug 10 may be hit substantially evenly across the bottom 18 by the hammer and/or the mallet until the plug 10 may be inserted into the damaged cell 89. The plug 10 may be deformable. The ridges 62 of the plug 10 may lock into place with the lip 96 of the interior wall 95 of the cell 82. The ridges 62 and/or the ledges 66 of the plug 10 may engage the lip 96 in the cell 82. When installed, the plug 10 may be flush with the bottom 79 of the sifting screen 80.

The sifter screen 80 may be inspected to ensure that the mesh layer 14 of the plug 10 is level with the mesh 81 of the sifting screen 80. As shown in FIG. 5, the mesh layer 14 of the plug 10 may be even with the top 79 of the sifting screen 80 and/or the mesh 81. The sifting screen 80 may be reinstalled into the industrial filtration system such as the shale shaker in an oil drilling operation, for example.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the present disclosure should be limited only by the attached claims.

The invention claimed is:

1. An apparatus comprising:

a plug having side walls arranged perpendicular to end walls in planes perpendicular to a top of the plug forming a hollow block having an interior passage extending from the top of the plug to a bottom of the plug located opposite with respect to the top of the plug, wherein the side walls have exterior surfaces extending in the planes perpendicular to the top of the plug between the end walls of the plug, wherein at least two ridges extend outwardly from the exterior surfaces of the side walls and at least one ledge extends outwardly from the exterior surfaces of the side walls between the at least two ridges along the side walls; and a mesh covering the top of the plug between the side walls and the end walls.

2. The apparatus of claim 1 wherein the ridges have a triangular cross-section.

3. The apparatus of claim 1 further comprising:

a convex wall adjoining the side walls wherein the convex wall extends downwardly from the top of the plug within the interior passage of the hollow block.

4. The apparatus of claim 1 further comprising:

a support member extending between the side walls in the interior passage of the hollow block.

5. The apparatus of claim 1 further comprising:

a rim extending from the top of the plug, wherein the mesh is attached to the rim with an adhesive.

6. The apparatus of claim 1 further comprising:

a rim extending from the top of the plug, wherein the mesh is integrally formed with the rim.

7. The apparatus of claim 1 wherein the side walls extend a first distance from the top and the end walls extend a second distance from the top wherein the second distance is greater than the first distance.

8. A system comprising:

a plug having a first end and a second end, wherein the first end is located in a position opposite to the second end and a first side and a second side, wherein the second side is located in a position opposite to the first side, and further wherein the first side extends a length from the first end to the second end and the second side extends a length from the first end to the second end, wherein the plug has a hollow interior portion defined between the first side and the second side and exterior surfaces on the first and second sides having ridges and at least one ledge located between the ridges along the exterior surfaces, wherein the ridges and at least one ledge extends outwardly from the exterior surfaces on the first and second sides of the plug, and further wherein the plug has a top having a first mesh attached thereto, wherein the entire height of the first end is greater than the entire height of the first side, when the plug is located in an upright position; and a screen having cells defined by an orthogonal array of ribs and a perimeter frame wherein the screen has a second mesh extending over the perimeter frame and further wherein the cells have interior walls with a lip located therein wherein the plug inserts within the interior walls of a damaged cell wherein the lip interfaces with the ridges on the plug to hold the plug in the damaged cell.

9. The system of claim 8, wherein the at least one ledge has a tapered portion on the exterior surfaces, and further wherein the lip interfaces with the tapered portion of the at least one ledge to hold the plug in the damaged cell.

10. The system of claim 8 wherein the plug has a shape corresponding to a shape of the damaged cell.

11. The system of claim 8 wherein the second mesh is attached to the orthogonal array of ribs and the perimeter frame wherein the second mesh is isolated between the cells.

12. The system of claim 8 further comprising:

a flat wall and a convex wall on the first end and on the second end wherein the convex wall is located within the hollow interior portion of the plug.

13. The system of claim 8 further comprising:

an intermediate support extending between the first side and the second side wherein the intermediate support is located in a position between the first end and the second end of the plug.

14. The system of claim 8 further comprising:

a cutting tool having cutting edges configured to sever the second mesh over the damaged cell.

15. A method comprising:

attaching a first mesh to a top of a plug having a shape of a hollow block;

identifying a damaged cell in a screen having cells wherein the screen is covered with a second mesh;

inserting the plug into the damaged cell, such that the plug is flush with a bottom of the screen that is located opposite with respect to the second mesh of the screen; and engaging a lip within the damaged cell with at least one ridge and at least one ledge of the plug, wherein the at least one ridge and the at least one ledge of the plug extend outwardly from at least one substantially planar exterior surface located on at least one side wall of the plug that extends downwardly from the top of the plug.

16. The method of claim 15 further comprising:

creating an interference fit between the plug and the damaged cell.

17. The method of claim 15 further comprising:

deforming the plug within the damaged cell.

18. The method of claim 15 further comprising:

aligning the plug within the damaged cell wherein the first mesh of the plug is flush with the second mesh of the screen.

19. The method of claim 15 further comprising:

cutting the second mesh covering the damaged cell.

* * * * *